US007097050B1

(12) United States Patent
McClellan et al.

(10) Patent No.: US 7,097,050 B1
(45) Date of Patent: Aug. 29, 2006

(54) DISPOSABLE TOOTHBRUSH HOLDER LINER

(76) Inventors: Tasi L. McClellan, 19 Encantado Canyon, Rancho Santa Margarita, CA (US) 92688; Michael R. McClellan, 19 Encantado Canyon, Rancho Santa Margarita, CA (US) 92688

( * ) Notice: Subject to any disclaimer, the term of this patent is extended or adjusted under 35 U.S.C. 154(b) by 213 days.

(21) Appl. No.: 10/770,660

(22) Filed: Feb. 2, 2004

(51) Int. Cl.
*A47B 81/02* (2006.01)

(52) U.S. Cl. ..... 211/65

(58) Field of Classification Search ..... 211/65, 211/66, 70.1, 70.6, 60.1, 62; 206/209.1, 206/362.3, 362.1, 15.3; 248/110
See application file for complete search history.

(56) References Cited

U.S. PATENT DOCUMENTS

| | | | | | |
|---|---|---|---|---|---|
| 791,101 | A | * | 5/1905 | Klein | 312/135 |
| 984,955 | A | * | 2/1911 | McMenamin | 211/62 |
| 1,013,662 | A | * | 1/1912 | Kramer | 211/62 |
| 1,051,433 | A | * | 1/1913 | Moseley et al. | 206/209.1 |
| 1,138,523 | A | * | 5/1915 | Withycombe | 206/209.1 |
| 1,155,343 | A | * | 10/1915 | Ekman | 206/209.1 |
| 1,181,862 | A | * | 5/1916 | Dye | 206/209.1 |
| 1,184,048 | A | * | 5/1916 | Tillman | 206/209 |
| 1,224,696 | A | * | 5/1917 | Wise | 206/209.1 |
| 1,228,261 | A | * | 5/1917 | Taylor | 211/65 |
| 1,303,884 | A | * | 5/1919 | Goodnow | 206/209.1 |
| 1,419,593 | A | * | 6/1922 | Thompson | 206/209.1 |
| 1,476,599 | A | * | 12/1923 | De Witt | 211/62 |
| 1,507,466 | A | * | 9/1924 | Collins | 206/209.1 |
| 1,553,648 | A | * | 9/1925 | Thompson | 206/362.2 |
| 1,565,684 | A | * | 12/1925 | Thesee | 206/209.1 |
| 1,579,958 | A | * | 4/1926 | Schwartz | 206/209.1 |
| 1,584,261 | A | * | 5/1926 | Vuolo | 206/362.1 |
| 1,586,332 | A | * | 5/1926 | Vinton | 206/209.1 |
| 1,625,202 | A | * | 4/1927 | Gindick | 206/209.1 |
| 1,792,356 | A | * | 2/1931 | Boiseau | 220/633 |
| 1,864,874 | A | * | 6/1932 | Voight | 206/362.3 |
| 1,972,532 | A | * | 9/1934 | McMillan | 248/111 |
| 1,975,691 | A | * | 10/1934 | Hibbs | 211/65 |
| 2,448,603 | A | * | 9/1948 | Kevin et al. | 401/129 |
| 2,545,171 | A | * | 3/1951 | Schroeder | 269/59 |
| 2,817,104 | A | * | 12/1957 | Hartzell | 401/125 |
| 2,943,745 | A | * | 7/1960 | Bjornson | 211/60.1 |
| 3,207,296 | A | * | 9/1965 | Goodall | 206/209.1 |
| 3,298,532 | A | * | 1/1967 | Wilcke | 211/70.6 |
| 3,344,930 | A | * | 10/1967 | Merkel | 211/65 |
| 3,367,610 | A | * | 2/1968 | Lindquist | 248/110 |
| 3,531,072 | A | * | 9/1970 | Lindquist | 248/113 |
| 3,661,270 | A | * | 5/1972 | Lucci et al. | 211/62 |
| 3,782,799 | A | * | 1/1974 | Hansen | 312/206 |
| 3,881,868 | A | * | 5/1975 | Duke | 206/209.1 |
| 4,033,650 | A | * | 7/1977 | Alissandratos | 312/206 |
| 4,311,262 | A | * | 1/1982 | Morin | 294/141 |
| 4,334,621 | A | | 6/1982 | Weber | |
| 4,585,119 | A | * | 4/1986 | Boyington | 206/209.1 |

(Continued)

*Primary Examiner*—Sarah Purol
(74) *Attorney, Agent, or Firm*—Walter A. Hackler

(57) ABSTRACT

A toothbrush liner for a toothbrush holder includes an elongate pouch sized for insertion into a toothbrush receptacle. A positioner is provided for supporting a toothbrush handle within the pouch and receptacle with a handle end in a spaced apart relationship with a pouch closed end thereby providing a reservoir for accumulation of liquid draining from the toothbrush after use. Alternatively, the liner may include a support web disposed adjacent a closed end of the liner for supporting the toothbrush handle end in a spaced apart relationship with a closed end of the liner in order to provide a reservoir or accumulation of liquid. The liners are disposable and accordingly provide for sanitary use of toothbrushes.

4 Claims, 2 Drawing Sheets

U.S. PATENT DOCUMENTS 4,754,877 A * 7/1988 Johansson et al. ..... 206/364
4,978,003 A * 12/1990 Foster ..... 206/217
4,995,509 A 2/1991 Kornfeind
5,139,142 A * 8/1992 Simon ..... 206/362.3
5,154,116 A * 10/1992 Dube ..... 99/403
D335,925 S * 5/1993 Newman ..... D24/128
5,261,541 A * 11/1993 Li ..... 211/62
5,285,906 A * 2/1994 Wisnowski et al. ..... 211/70.5
5,333,742 A * 8/1994 Piedmont et al. ..... 211/65
D356,915 S 4/1995 Torres et al.
5,415,157 A * 5/1995 Welcome ..... 600/121
5,484,065 A 1/1996 Davoli, Jr.
5,522,497 A * 6/1996 Stacy ..... 206/209.1
D371,851 S * 7/1996 DeRosa ..... D24/217
5,657,883 A * 8/1997 Badia ..... 211/70.8
D385,633 S * 10/1997 De Rosa ..... D24/217
5,687,855 A 11/1997 Heller
5,690,214 A * 11/1997 Gaines et al. ..... 206/209.1
5,692,603 A * 12/1997 Stotesbury ..... 206/209.1
5,725,091 A * 3/1998 Knoebel ..... 206/209.1
5,938,049 A * 8/1999 Susholz ..... 211/62
6,186,324 B1 * 2/2001 Catterson ..... 206/362.1
6,325,222 B1 * 12/2001 Avery et al. ..... 211/65
RE37,535 E * 2/2002 Avery et al. ..... 206/362.2
6,401,943 B1 6/2002 Root
D461,670 S * 8/2002 Hill ..... D6/528
6,534,015 B1 * 3/2003 Viot et al. ..... 422/102
2004/0035808 A1 * 2/2004 Berry ..... 211/70.6

* cited by examiner

DISPOSABLE TOOTHBRUSH HOLDER LINER

Many toothbrush holders on the market today are flawed in terms of sanitary and cleanliness issues. Currently, there are two basic types of toothbrush holders on the market today: Standard rack-type open holders, and container-type holders. A rack-type holder is basically a toothbrush rack, where the toothbrush is hung from the rack, which is either supported by some form of mounting apparatus, or is attached to a wall or a fixture. The difficulty with rack-type holders is that they offer no place for the water to drain from the toothbrush, and the water generally runs onto a counter or other surface, requiring frequent cleaning. The container-type holder generally comprises a ceramic, metal or plastic receptacle with holes for receiving the toothbrush. The design of these toothbrush holders does not allow the water and deposits that drain from a toothbrush to go anywhere but the bottom of the holder. This water then accumulates in the bottom of the holder. As a result, the end of the toothbrush handle is often in contact with this runoff, and the stagnant water becomes a breeding ground of germs. Since these holders generally allow only limited access to the inside, they can quickly become unsanitary, difficult to clean and give off an unpleasant odor, and often the maintenance of an attractive toothbrush holder without an unpleasant odor requires the frequent disposal of the holder and purchase of a replacement.

Several disposable toothbrush holders are known in the art. However, such disposable holders are generally designed for use in hotel rooms and similar situations where the occupant frequently changes.

For home use, many people prefer to have a toothbrush holder that provides a decorative touch to bathrooms. As such, any improvement which helps to maintain the cleanliness and sanitation of these decorative holders would represent a significant contribution to the art.

SUMMARY OF THE INVENTION

A toothbrush liner, in accordance with the present invention, is provided for various toothbrush holders. One such holder suitable for the present invention includes a receptacle with a depth for supporting at least one toothbrush handle end with a toothbrush head held above the receptacle.

Another toothbrush holder for which the present invention finds advantage is a holder having at least one opening for receiving a toothbrush handle.

In one embodiment of the present invention, a toothbrush liner includes an elongate pouch which is sized for insertion into the receptacle with the elongate pouch having an open end and a closed end and a length a longer than a length of the toothbrush handle.

A positioner is provided for supporting the toothbrush handle within the receptacle and pouch with the handle end in a spaced apart relationship with the elongate pouch closed end.

In this manner, any excess fluid draining from the handle is accumulated within the pouch and out of contact with the receptacle and handle thereby providing sanitary storage of the toothbrush. The pouch is preferably disposable and accordingly, the toothbrush holder may be used continuously without unnecessary sanitization thereof.

Preferably, the positioner is disposed on an interior of the pouch and molded integrally therewith in order to provide economic manufacture of the liner.

A fastener is preferably provided for releasably securing the pouch to the receptacle. Such a fastener may manifest itself in the form of a lip disposed around the liner open end which may be elastic to facilitate both installation and removal of the liner from the receptacle.

For use with a toothbrush holder having at least one opening for receiving a toothbrush handle with no receptacle depending therefrom, the toothpaste liner in accordance with the present invention provides for an elongate pouch sized for insertion through the opening with the elongate pouch having an open end and a closed end and a length greater than the length of a toothbrush handle.

As hereinabove described, a positioner is provided for supporting a toothbrush handle within the elongate pouch with the handle end and a spaced apart relationship with the elongate pouch closed end.

In another embodiment of the present invention, a support web is provided and disposed adjacent the closed end for supporting the toothpaste handle end in a spaced apart relationship with the closed end to define a reservoir for enabling accumulation of liquid draining from the toothbrush handle and separation of said liquid from the toothpaste handle in order to provide sanitary storage of the toothbrush.

BRIEF DESCRIPTION OF THE DRAWINGS

The advantages and features of the present invention will be better understood by the following description when considered in conjunction with the accompanying drawings in which.

DETAILED DESCRIPTION

Figure 1:
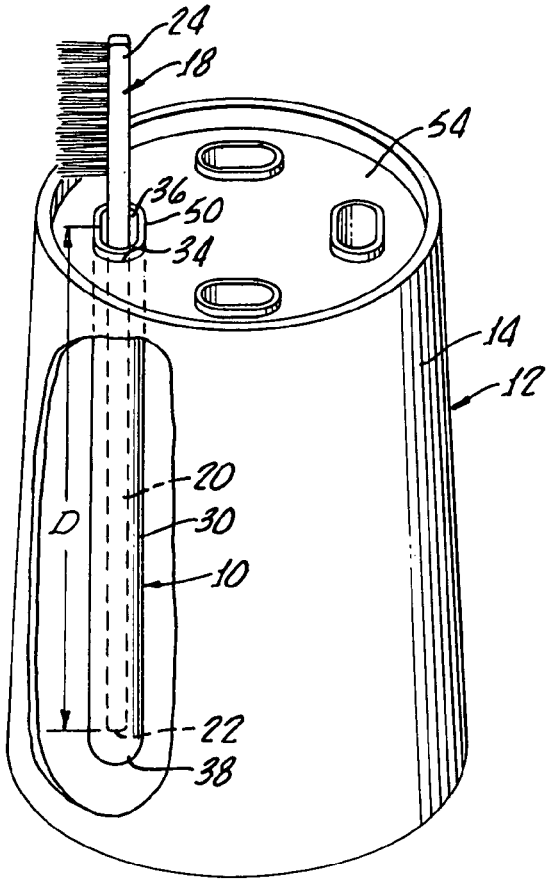
FIG. 1 is a perspective view of one embodiment of the present invention which includes a toothbrush liner for a toothbrush holder having a receptacle with a depth for supporting at least one toothbrush handle end with a toothbrush head held above the receptacle, the liner generally including a pouch sized for insertion into the receptacle.

With reference to FIG. 1, there is shown a toothbrush liner 10 and accordance with the present invention suitable for a toothbrush holder 12 which includes a receptacle 14 therein with a depth D for supporting at least one toothbrush 18 having a handle 20 with an end 22 for supporting a toothbrush head above the receptacle 14. The liner 10 includes a pouch 30 which may be formed from any suitable material which is sized for insertion in the receptacle through an opening 34. The pouch 30 includes an open end 36 and a closed end 38.

Figure 2:
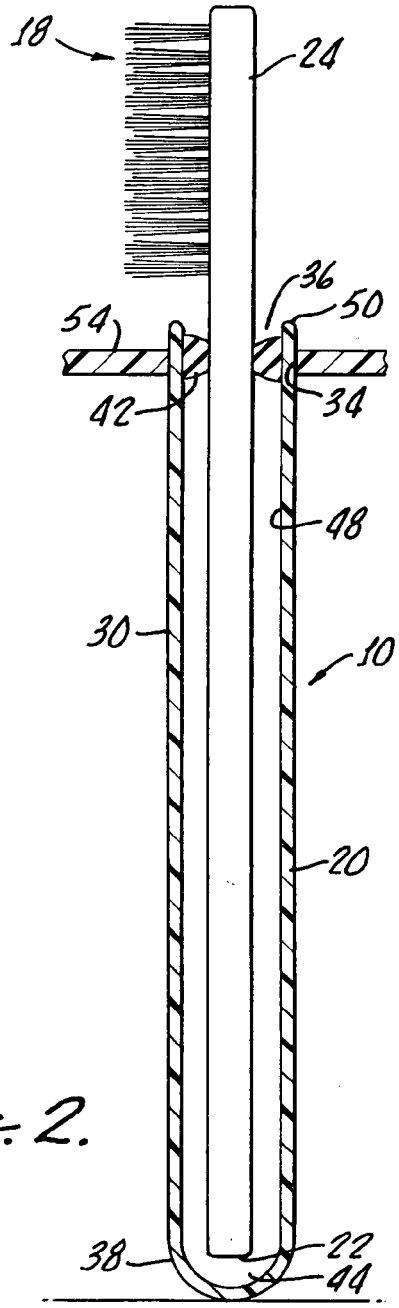
FIG. 2 is a cross sectional view of an embodiment of the present invention illustrating a placement of a toothbrush within the liner which includes a positioner for supporting the toothbrush handle within the receptacle and pouch with a handle end in a spaced apart relationship with a closed end of the elongate pouch.

As more clearly shown in FIG. 2, the liner includes a positioner 42 for supporting the toothbrush handle 20 within the pouch 30 with the handle end 22 in a space apart relationship with the pouch closed end 38. This basically establishes a reservoir 44 for accumulation of water.

Without the liner 10, if the holder 12 has an open bottom, such water runs off onto a bathroom countertop and if the holder 12 has a closed bottom, stagnant water accumulating therein becomes a breeding ground for germs which may thereafter come in contact with the toothbrush.

The toothbrush liner 10, in accordance with the present invention does not allow the toothbrush to come in contact with these deposits and thus the germs do not come in contact with the toothbrush handle and ultimately the users hand.

The toothbrush liner 10, in accordance with the present invention is preferably formed from suitable plastic materials which are disposable and this in turn makes cleaning very easy. This should be contrasted with standard multi-toothbrush holders which normally provide very little access to the inside thereof which makes cleaning very difficult.

This in turn induces the use of harsh chemicals by users in an attempt to rid the holders of particulates and deposits therein. Such cleaning is avoided with the use of the liner 10 in accordance with the present invention.

Concomitant with the drainage and runoff of water in the bottom of conventional toothbrush holders are foul smelling odors. The use of the liner 10 in accordance with the present invention eliminates this unpleasant occurrence since the liner 10 in accordance with the present invention is easily removed and disposed.

With continued reference to FIG. 2, the positioner 42 may be a circumferential berm, or node, formed on an interior surface 48 and preferably is integrally formed therewith. The positioner 42 is resilient for enabling capture of the toothbrush handle 20 and suspension thereof within the pouch 30 by frictional engagement therewith.

The pouch 10 may be relatively rigid or relatively compliant and in the latter instance, a fastener in the form of a lip 50 may be formed at and surrounding the opening 36 of the pouch 30 for securing for securing the pouch 30 to the opening 34, see FIGS. 1 and 2.

If the opening 34 includes a sufficient protrusion 50 from a top 54 of the holder 12, the lip may be formed of, or include, an elastic material for securing the open end 36 of the pouch 30 thereto.

Otherwise, the lip may be relatively rigid for preventing passage of the pouch opening 36 past the opening 34 of the holder 12. Preferably, the lip is both more rigid and elastic in order that the liner may be utilized in a variety of holders 12.

Figure 3:
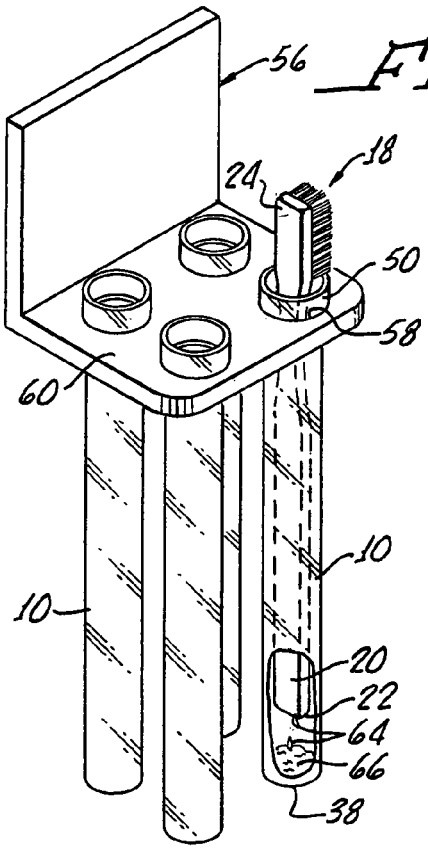
FIG. 3 is a perspective view of an alternative embodiment of the present invention illustrating a toothbrush liner for a toothbrush holder having at least one opening for receiving a toothbrush handle.

With reference to FIG. 3, the liner 10 is also suitable for a toothbrush holder 56 having openings 58 for receiving toothbrushes 24. In this instance, the lip 50 prevents passage of the liner through a deck 60 and positioners 42, not shown in FIG. 3, suspend the toothbrush end 22 above the closed end 38 allowing droplets 64 to accumulate as collected water 66 at the closed end 38.

Typical dimensions of the liner 10 include a liner diameter between $5/8^{th}$ of an inch and ¾ of an inch and a total length of between 3 and 4 inches.

Figure 4:
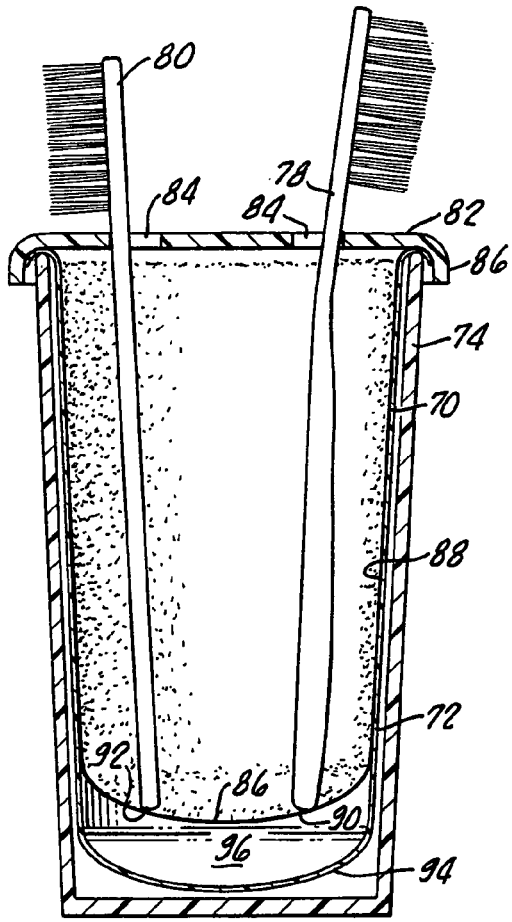
FIG. 4 is a cross sectional view of an alternative embodiment of the present invention in which a pouch includes a support web disposed adjacent the closed end for supporting the toothbrush handle end in a spaced apart relationship with the closed end to define a reservoir for enabling accumulation of liquid draining from the toothbrush handle in order to separate said liquid from the toothbrush handle.

With reference now to FIG. 4, there is shown an alternative embodiment liner 70 in accordance with the present invention which includes a pouch 72 suitable for being received in a receptacle 74 designed for receiving multiple toothbrushes 78, 80 through a top 82 having a plurality of openings 84. The pouch 72 is secured to the receptacle 74 by means of a lip 86 similar to the lip 50 hereinbefore described.

The liner 70 includes a support web 86 formed in, or otherwise attached to an interior surface 88 of the pouch 72 for supporting ends 90, 92 of toothbrushes 78, 80 in a spaced apart relationship with a closed end 94 of the pouch 72 to defined a reservoir 96 for enabling accumulation of fluid draining from the toothbrushes 78, 80 and separating the liquid from the toothbrushes 78, 80.

Figure 5:
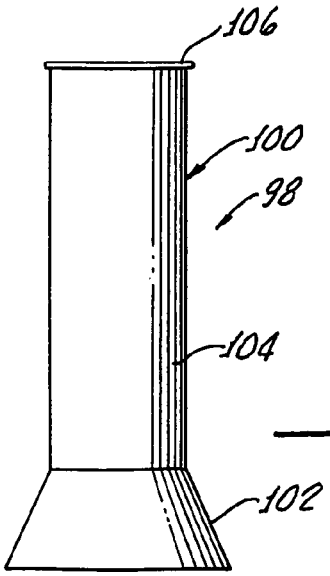
FIG. 5 is a side view of a pouch in accordance with the present invention illustrating an embodiment in which the reservoir has an increased diameter for accumulation of fluids.

An alternative embodiment liner 98 is illustrated in FIG. 5 which includes a pouch 100 having a reservoir 102 of greater diameter than the pouch and body 104.

The pouch 100 may be secured to an opening, not shown by a lip 106 similar to the lip 50 hereinabove described. This configuration provides for a greater accumulation of fluids.

Although there has been hereinabove described a specific disposable toothbrush holder liner in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A toothbrush liner for a toothbrush holder, said toothbrush liner comprising:

an elongate pouch sized for insertion into said toothbrush holder, said elongate pouch having an open end, a closed end and a diameter preventing insertion of a toothbrush head into the pouch thereby mandating support of the toothbrush head with a toothbrush outside of the pouch;

a support web, disposed inside the pouch and adjacent the closed end, for supporting a toothbrush handle end in a spaced apart relationship with the closed end; and a reservoir, disposed between the web and the closed end, for enabling accumulation of liquid draining from said toothbrush handle end in order to separate said liquid from said toothbrush handle end.

2. The toothbrush liner according to claim 1 further comprises a fastener for releasably securing said pouch to said toothbrush holder.

3. The toothbrush liner according to claim 2 wherein said fastener comprises a lip disposed around the pouch open end.

4. The toothbrush liner according to claim 3 wherein said lip and pouch are elastic.

* * * * *